US006918450B2

(12) United States Patent
Lebisch et al.

(10) Patent No.: US 6,918,450 B2
(45) Date of Patent: Jul. 19, 2005

(54) ELECTRIC HAND POWER TOOL

(75) Inventors: Helmut Lebisch, Stuttgart (DE); Otto Baumann, Leinfelden-Echterdingen (DE); Dietmar Saur, Gomaringen (DE); Michael Weiss, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/786,382

(22) Filed: Feb. 25, 2004

(65) Prior Publication Data

US 2004/0188117 A1 Sep. 30, 2004

(30) Foreign Application Priority Data

Mar. 24, 2003 (DE) ..... 103 12 980

(51) Int. Cl.[7] ..... B25D 17/00
(52) U.S. Cl. ..... 173/104; 173/109
(58) Field of Search ..... 173/47, 48, 104, 173/109, 201

(56) References Cited

U.S. PATENT DOCUMENTS 4,719,976 A * 1/1988 Bleicher et al. ..... 173/109
4,770,254 A * 9/1988 Kominami ..... 173/109
5,379,848 A * 1/1995 Rauser ..... 173/48
6,109,364 A * 8/2000 Demuth et al. ..... 173/48
6,192,996 B1 * 2/2001 Sakaguchi et al. ..... 173/48
6,460,627 B1 * 10/2002 Below et al. ..... 173/48
6,789,630 B2 * 9/2004 Quirijnen et al. ..... 173/48

FOREIGN PATENT DOCUMENTS

DE 28 20 128 11/1979

* cited by examiner

*Primary Examiner*—Rinaldi I. Rada
*Assistant Examiner*—Nathaniel Chukwurah
(74) *Attorney, Agent, or Firm*—Michael J. Striker

(57) ABSTRACT

An electric hand power tool formed as a hammer drill or an impact hammer drill has a housing, a drive transmission received in the housing and having an intermediate transmission for turning a tool, an impact mechanism with a swinging drive for delivering axially oriented impacts to the tool, and a drive shaft, a transmission toothed wheel fixed on the transmission shaft for turning the latter, a drive bearing provided on the swinging drive and loosely arranged on the transmission shaft, a manually releasable coupling provided for switching off the impact mechanism and connecting the drive bearing with the transmission shaft for a rotation transmission, a crank-shaped flat switching plate provided for releasing the coupling and turnably supported on a receiving dome arranged above the transmission shaft, a drive pin operative for turning the switching plate under the receiving dome and engaging the switching plate, and a handle.

11 Claims, 2 Drawing Sheets

ELECTRIC HAND POWER TOOL

BACKGROUND OF THE INVENTION

The present invention relates to an electric hand power tool, in particular a hammer drill or an impact hammer drill.

In a known hammer drill or an impact hammer drill disclosed in German patent document DE 28 20 128 a tool receptacle which receives a tool in non-rotatable and axially displaceable manner is coupled with a rotary sleeve provided with a toothed ring in engagement with a transmission toothed wheel arranged on a transmission shaft. An impact mechanism has a drive piece which is guided reciprocatingly and axially displaceably in the rotary sleeve, and a striker which is striken by the drive piston through an air cushion and transmits its impact energy to the tool which is held axially displaceable in the tool receptacle. The drive piston is driven through a swinging drive from the transmission shaft. The swinging drive has a drive bearing non rotatably seated on the transmission shaft and formed by two drum halves. The drum halves form therebetween a ring groove with a ring axis extending at an acute angle to the shaft axis, and a ring is rotatably held in the ring groove. A radially extending drive piston arranged on the ring engages with a clearance in a transverse opening located inside a rotary pin. The rotary pin in turn engages a fork-shaped end of the drive piston located at a side facing away from the striker. The transmission toothed wheel seated non rotatable on the transmission shaft engages, for rotation of the transmission shaft, with a drive pinion which is formed on a driven shaft of an electric motor. By turning on the electric motor the transmission shaft is set in rotation, and through the intermediate transmission the rotary sleeve and thereby the tool is turned, and the impact mechanism is set in operation through the swinging drive. A device for turning off of the impact mechanism is not provided.

Electric hand power tools are known, in which for turning off the impact mechanism in an operational state "rotary drilling" the drive bearing of the swinging drive sits loose on the transmission shaft and is connected through a manually releasble coupling with a transmission shaft for rotary driving. With manual release of the coupling, the rotary driving between the transmission shaft and the drive bearing of the swinging transmission is lifted and thereby the operation of the switching mechanism is stopped.

SUMMARY OF THE INVENTION

Accordingly, it is an object of the present invention to provide an electric hand power tool, which avoids the disadvantages of the prior art.

In keeping with these objects and with others which will become apparent hereinafter, one feature of the present invention resides, briefly stated, in an electric hand power tool formed as a hammer drill or an impact hammer drill, which has a housing, a drive transmission received in the housing and having an intermediate transmission for turning a tool, an impact mechanism with a swinging drive for delivering axially oriented impacts onto the tool, and a drive shaft, a transmission toothed wheel fixed on the transmission shaft for turning the latter, a drive bearing provided on the swinging drive and loosely arranged on the transmission shaft, a manually releasable coupling provided for switching off the impact mechanism and connecting the drive bearing with the transmission shaft for a rotation transmission, a crank-shaped flat switching plate provided for releasing the coupling and turnably supported on a receiving dome arranged above the transmission shaft, a drive pin operative for turning the switching plate under the receiving dome and engaging the switching plate, and a handle which is available outside of the housing and displacing the drive pin in a longitudinal direction of the transmission shaft.

When the electric hand power tool is designed in accordance with the present invention it has the advantage that due to the flat switching plate and its support above the transmission shaft, a volume-reduced system for many areas of the coupling is provided, which can be simply integrated in the machine housing and does not need a change of the continuous, "soft" contour of the inner shell of the machine housing which is important for the sealing of the drive transmission.

In accordance with a preferable embodiment of the present invention the handle for the separation of the coupling has a gripping shaft rotatably held in the housing and a gripping handle fixedly connected with it. The drive pin shaft engaging the switching plate extends with a radial distance from the rotary axis of the gripping shaft at an end side outwardly of the gripping shaft and engages in a pocket formed in the switching plate. When the handle is formed in accordance with these features, the position for the handle for releasing the coupling is independent from the position of the transmission shaft which carries the coupling. At the same time, with the use of a lever action of the switching plate, during the release of the coupling the rotary path of the gripping handle can be made sufficiently great for reaching an ergonomically advantageous switching off of the impact mechanism.

In accordance with a preferable embodiment of the present invention, a spring is integrated in the gripping handle, which is tensioned during turning of the gripping handle in direction of separation of the coupling. With this type of the integration of the spring in the gripping handle it is guaranteed that the operator can bring a certain force to turn off the impact mechanism and this switching off process is not released in unauthorized way.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
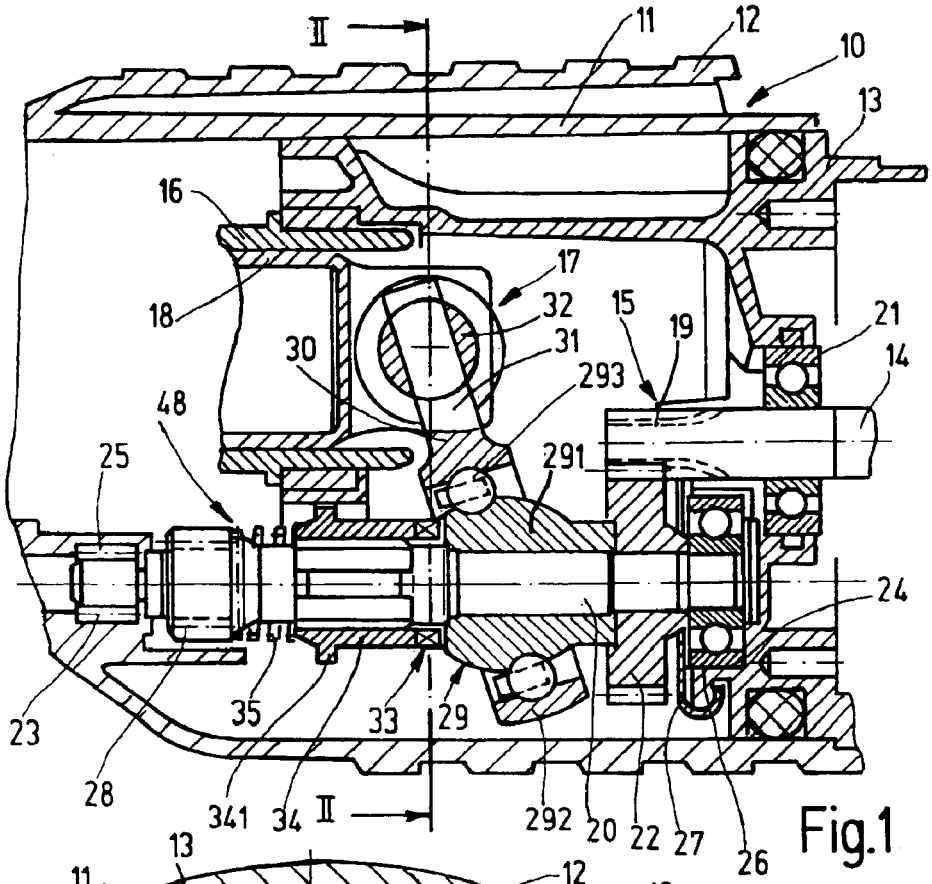
FIG. 1 shows a part of a longitudinal section of a hammer drill in accordance with the present invention.

An electric hand power tool illustrated in FIG. 1 is formed in the shown example as a hammer drill, of which a portion of a longitudinal section is shown in the drawings. The hammer drill has a housing 10 with an inner housing shell 11 and an outer housing shell 12 as well as an intermediate flange 13. An electric drive motor with a driven shaft 4 is accommodated in the interior of the housing 10 in a known manner. It drives rotatably a rotary sleeve 16, and also drives an impact mechanism 17 through a drive transmission 15 in a translatory movement.

The rotary sleeve 16 is coupled with a tool receptacle in a manner which is not shown in the drawings. A tool, for example an impact drill, is clamped in the tool receptacle and is rotatable in a rotary direction together with the tool receptacle and also can perform a limited reciprocating displacement movement of the tool receptacle. The impact mechanism 7 has a drive piston 18 which is reciprocatingly axially displaceably guided in the rotary sleeve 16, and a not shown striker which is striken by the drive piston 18 through an air cushion and transmits its impact energy to the tool which is axially displaceably held in the tool receptacle. A complete illustration and description of the tool receptacle with the tool and the components of the impact mechanism 17 is provided for example in the German patent document DE 28 20 128 A1, which is incorporated here as a reference.

Both the rotary movement of the rotary sleeve 16 and the translatory movement of the drive piston 18 are performed by means of a transmission shaft which is identified here as an intermediate shaft 20, from the driven shaft 14 of the electric motor. For this purpose a drive pinion 19 is formed on the driven shaft 14 and engages with a transmission toothed wheel which is indicated here as an intermediate toothed wheel 22 and pressed on the intermediate shaft 20. The driven shaft 14 with its shaft portion directly adjacent to the drive piston 19 is received in a ball bearing 21 which is fixed in the intermediate flange 13.

The intermediate shaft 20 is rotatably supported in the housing 10 by two radial bearings 23, 24 which are arranged on opposite end portions of the intermediate shaft 20 with press fit. The left radial bearing 23 in FIG. 1 is formed as a needle bearing which is received in a corresponding bearing receptacle 25 of the housing 10. The right radial bearing 24 in FIG. 1 is formed as a ball bearing which is received in a bearing shaft 26 formed of one piece in the intermediate flange 13 and fixed against axial displacement by a clamping plate 26 which in turn is fixed on the intermediate flange 13. Near the left radial bearing 22 in FIG. 1, the intermediate shaft 20 supports an intermediate pin 28 of an intermediate transmission 48 for a rotary drive of the tool receptacle, which engages with a not shown intermediate toothed wheel engaging in a toothed rim formed on the rotary sleeve 16.

A drive bearing 29 of a swinging transmission 30 which drives the impact mechanism 17, and the coupling for manual switching on and switching off of the impact mechanism 17 to or from the rotatable tool are arranged between the intermediate pinion 28 and the intermediate toothed wheel 22 on the intermediate shaft 20. The drive bearing 23 sits loose on the intermediate shaft 20 and its bearing axis forms an acute angle relative to the axis of the intermediate shaft 20. The drive bearing 29 has an inner bearing body 291 received by the intermediate shaft 20, an outer bearing ring 292 and a plurality of balls 293 which support the outer bearing ring 292 on the inner bearing 291. The outer bearing ring 292 carries a radially projecting drive pin 31 which engages with a clearance in a transverse opening of a rotary pin 32. The rotary pin 32 is held in turn in a fork-shaped end of the drive piston 18.

Figure 3:
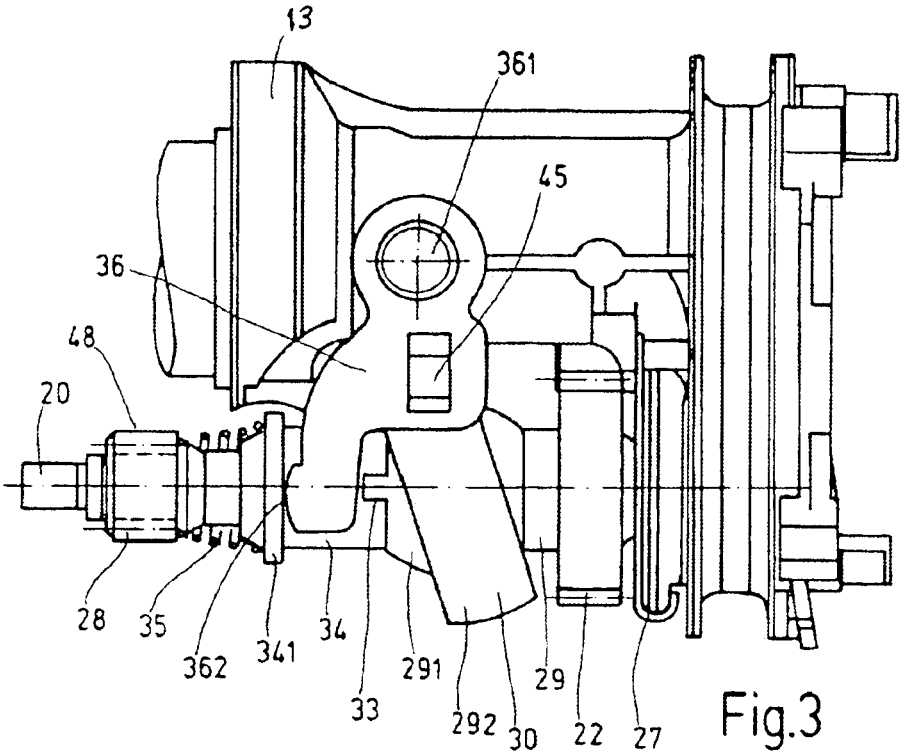
FIG. 3 is a portion of a side view of an intermediate flange of a hammer drill in FIG. 1 with an active impact mechanism in accordance with the present invention.

The coupling 33 formed as a claw coupling has two coupling parts which engage one another form-lockingly in a rotary direction by their claws. The claw engagement is produced by a coupling spring acting in an axial direction. One coupling part of the coupling 33 is formed by the inner bearing body 291 of the drive bearing 29 of the swinging transmission 30, while the other coupling part is formed by a coupling ring 34 which is arranged non rotatably and axially displaceably on the intermediate shaft 20. The coupling spring is formed as a helical pressure spring 35. It sits on the intermediate shaft 20, and on one hand is supported on the intermediate pinion 28 and on the other hand is supported on the coupling ring 34, so as to press the coupling ring 34 in an axial direction to the inner bearing body 291. The inner bearing body 291 is axially supported on the intermediate toothed wheel 22. In standard operation "impact drilling" the coupling is closed as shown in FIGS. 1 and 3, so that through the claws of the coupling 33 which are in engagement with one another, the inner bearing body 291 is driven in a rotary direction through the coupling 34 during the rotation of the intermediate shaft 20.

Figure 2:
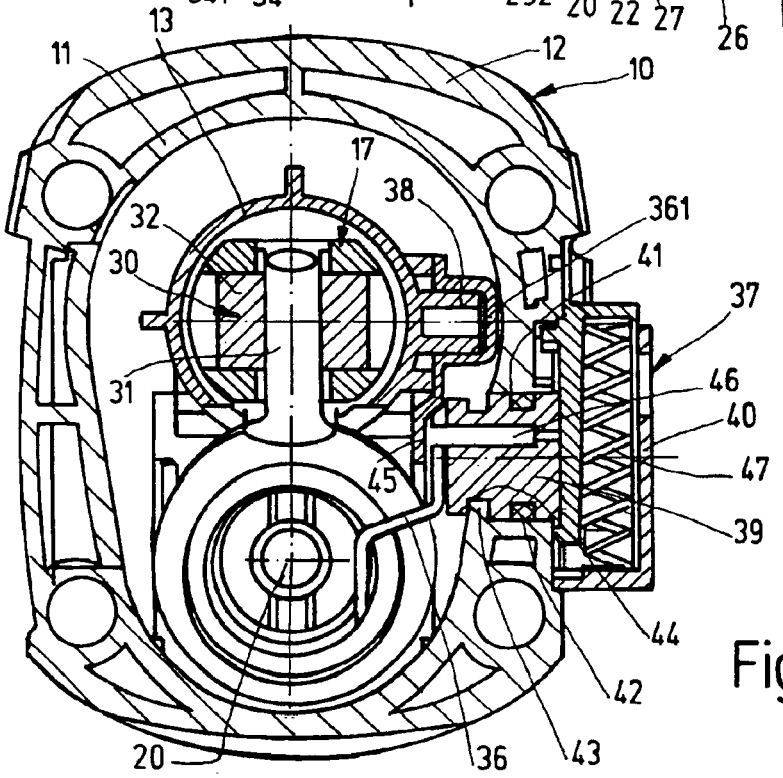
FIG. 2 is a view showing a section of the hammer drill taken along the line II—II in FIG. 1.

At its one ring end the coupling ring 34 carries a radial flange 341, and the pressure spring 35 abuts against this radial flange. A crank-shaped flat switching plate 36 shown in FIGS. 2–4 engages the ring face of the radial flange 341 which faces away from the pressure spring 35. The switching plate 36 is actuatable for releasing the coupling 33 by axial displacements of the coupling ring 34 by means of an outwardly accessible handle 37 arranged on the housing 10. The switching plate 36 is formed as a deep-drawn part having a cap-shaped curvature 361, with which it seats concentrically on a receiving dome 38 formed above the intermediate shaft 20 on the intermediate flange 13. The axial length of the receiving dome 38 is dimensioned so that the cap-shaped curvature 361 of the switching plate 36 is located with a low clearance between the end side of the receiving dome 38 and the inner housing shell 11.

The handle 37 is composed of a handle shaft 39 and a handle part 40 fixedly connected with one another. The handle shaft 39 is rotatably arranged in a cylindrical housing opening 41 which is formed on the housing wall and extends through the inner and outer housing shells 11, 12. It is sealed by a sealing ring 42 against the housing wall. A spring 47 is integrated in the handle button 40 and tensioned during rotation of the handle part 40 in a rotary direction for releasing the coupling 33. The handle part 40 which is tensioned in a back rotary direction is arrestable in a rotary end position. The handle shaft 39 is fixed against axial displacement by an arc-shaped web 43 which projects at the end of the housing opening 41 radially into the housing 41 and engages form-lockingly in a ring-groove 44 which is cut in the handle shaft 39. A flat, central portion of the switching plate 36 is placed on the end surface of the handle shaft 39.

The length of the handle shaft 39 is determined so that the switching plate 36 which abuts with its crank-shaped end against the outer surface of the coupling ring 34, is located between the coupling ring 34 and the handle shaft 39 only with a small clearance. In order to illustrate the crank shape of the switching plate 36 in the region of the handle shaft 39 and the coupling ring 34, in the sectional illustration in FIG. 2 this region of the switching plate 36 is shown without hatching, while in the sectional view along the line II—II in FIG. 1, it can not be seen.

Figure 4:
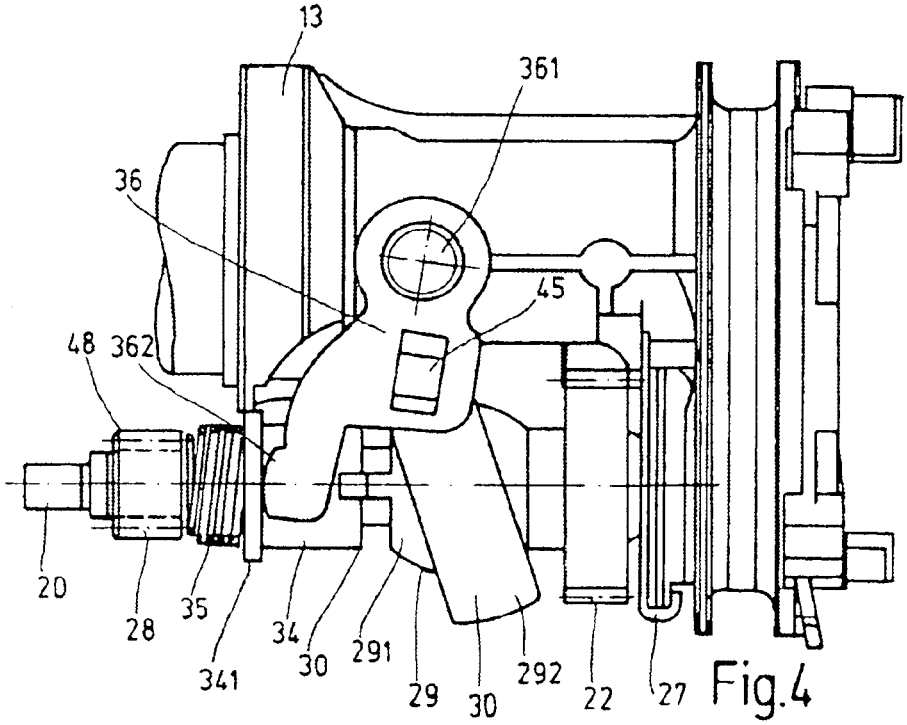
FIG. 4 is a view substantially corresponding to the view of FIG. 3 with the turned off impact mechanism in accordance with the present invention.

A pocket 45 is formed in a central, flat region of the switching plate 36 which is located in the region of the handle shaft 39. A drive pin 46 extending from the handle shaft 39 engages in the pocket 45. The drive pin 46 is fixed at a radial distance from the rotary axis of the handle shaft 39 so that during turning of the handle shaft 39 it is moved on a circular arc around the rotary axis of the handle shaft 39. As shown in FIGS. 3 and 4, the switching plate 36 is placed on a free, lower end region on a ring surface which faces away from the pressure spring 35 of the coupling 33 and is provided on the radial flange 341 formed on the coupling ring 34. For obtaining a flat abutment between the switching plate 36 and the radial flange 341, the longitudinal edge of the switching plate 36 is curved convexly.

In the basic position of the handle part 40, the coupling 33 is closed by the pressure spring 35 and the impact mechanism 17 is active. The switching plate 36 lies without force application "loosely" between the radial flange 341 of the coupling 34 and the drive bearing 29 of the swinging transmission 30 as shown in FIG. 3. The hammer drill is in the operational stage "impact drilling". For adjusting the operational stage to "rotary drilling", the handle button 40 is turned against the return force of the spring 47 in FIG. 3 in a clockwise direction over a predetermined rotary path and arrested at the end of the rotary path, while the spring 47 is tensioned. The drive pin 46 which moves on an eccentric circle turns the switching plate 36 in the rotary direction shown in FIG. 4, whereby the switching plate 36 is displaced to the left in FIG. 4 via a convex longitudinal edge 362 and a radial flange 341 of the coupling ring 34 until the claws of the coupling 33 disengage. By arresting the gripping part 40 in its disengaged position of the claws, the coupling 33 is held in its open position. The rotating intermediate shaft 20 now does not drive any longer the inner bearing body 291 of the drive bearing 29 of the swinging transmission 30, so that the drive piston 18 is not driven in a reciprocating axial movement and thereby no impact forces act on the rotary tool. The hammer drill operates as a pure drilling tool.

When the handle part 40 is manually lifted again from its arresting position, the coupling 33 is automatically closed by the pressure spring 35 and the handle part 40 is again set back to its operational condition "impact drilling" identified as a basic position.

The present invention can be used also for the coupling between a rotary drive and an impact mechanism in an impact hammer drill, which the standard operation is drilling and the impact mechanism is activated for example by a corresponding closing of the coupling.

It will be understood that each of the elements described above, or two or more together, may also find a useful application in other types of constructions differing from the types described above.

While the invention has been illustrated and described as embodied in electric hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims.

What is claimed is:

1. An electric hand power tool selected from the group consisting of a hammer drill and an impact hammer drill, comprising a housing; a drive transmission received in said housing and having an intermediate transmission for turning a tool; an impact mechanism with a swinging drive for delivering axially oriented impacts to the tool; a drive shaft; a transmission toothed wheel fixed on said transmission shaft for turning the latter; a drive bearing provided on said swinging drive and loosely arranged on said transmission shaft; a manually releasable coupling provided for switching off said impact mechanism and connecting said drive bearing with said transmission shaft for a rotation transmission; a crank-shaped flat switching plate provided for releasing said coupling and turnably supported on a receiving dome arranged above said transmission shaft; a drive pin operative for turning said switching plate under said receiving dome and engaging said switching plate; and a handle which is available outside of said housing and displacing said drive pin in a longitudinal direction of said transmission shaft.

2. An electric hand power tool as defined in claim 1, wherein said handle has a handle shaft which is rotatably held in said housing and a handle button fixedly connected with said handle shaft, said drive pin extending at a radial distance from a rotary axis of said handle shaft at an end side outside of said handle shaft and engaging in a pocket formed in said switching plate.

3. An electric hand power tool as defined in claim 2, wherein said switching plate has a central flat surface region with which it abuts against an end side of said handle shaft with a small clearance and also a crank-shaped end portion with which it abuts against an outer surface of a coupling ring of said coupling with small clearance.

4. An electric hand power tool as defined in claim 1; and further comprising a spring which is integrated in said handle button and is tensioned by turning said handle button in a direction of release of said coupling.

5. An electric hand power tool as defined in claim 1, wherein said coupling has a stationary coupling part and a displaceable coupling part which is engageable with said stationary coupling part through a coupling spring, said stationary coupling part being formed by said drive bearing of said swinging drive which loosely sits on said transmission shaft while said displaceable coupling part is formed by a coupling ring which has a radial flange and sits non-turnably and axially displaceably on said transmission shaft, said switching plate engaging said radial flange for releasing said coupling.

6. An electric hand power tool as defined in claim 5, wherein said coupling is formed as a claw coupling, said coupling spring being formed as a helical pressure spring fitted on said transmission shaft and pressing said coupling ring to said drive bearing which in turn is axially supported on said transmission toothed wheel mounted on said transmission shaft.

7. An electric hand power tool as defined in claim 6, wherein said transmission toothed wheel is mounted on said transmission shaft with press fit.

8. An electric hand power tool as defined in claim 6, wherein said switching plate has a longitudinal edge which faces said radial flange of said coupling ring and is convexly curved in a region of its abutment against said radial flange.

9. An electric hand power tool as defined in claim 5, wherein said switching plate has a longitudinal edge which faces said radial flange of said coupling ring and is convexly curved in a region of its abutment against said radial flange.

10. An electric hand power tool as defined in claim 1, wherein said switching plate is formed as a deep drawn part and has a cap-shaped convexity which surrounds said receiving dome concentrically with a small rotary clearance.

11. An electric hand power tool as defined in claim 10, wherein said receiving dome has an axial length such that said switching plate in a region of said cap-shaped convexity is held with a small clearance between an end side of said receiving dome and an inner housing shell of said housing.

* * * * *